US005678698A

United States Patent [19]

Cabral

[11] Patent Number: 5,678,698

[45] Date of Patent: Oct. 21, 1997

[54] BASEBALL BAT RACK FOR BASEBALL HATS AND RELATED ARTICLES

[76] Inventor: Derek L. Cabral, 94-223 Paioa Pl. No. D205, Waipahu, Hi. 96797

[21] Appl. No.: 620,255

[22] Filed: Mar. 22, 1996

[51] Int. Cl.[6] ..... A47F 7/00

[52] U.S. Cl. ..... 211/33

[58] Field of Search ..... 211/33, 13, 30, 211/205, 196

[56] References Cited

U.S. PATENT DOCUMENTS

| | | | |
|---|---|---|---|
| D. 285,147 | 8/1986 | LeCocq, Jr. . | |
| D. 363,613 | 10/1995 | Ehrmann . | |
| 1,089,290 | 3/1914 | Thompson | 211/205 X |
| 1,747,951 | 2/1930 | Reichert . | |
| 2,010,093 | 8/1935 | Lazarus . | |
| 3,547,275 | 12/1970 | Engel | 211/205 |
| 4,889,246 | 12/1989 | Lee | 211/205 X |

FOREIGN PATENT DOCUMENTS

| | | | |
|---|---|---|---|
| 1490589 | 8/1967 | France | 211/205 |
| 184223 | 5/1906 | Germany | 211/205 |

*Primary Examiner*—Alvin C. Chin-Shue
*Assistant Examiner*—Sarah L. Purol
*Attorney, Agent, or Firm*—Michael I. Kroll

[57] ABSTRACT

A baseball bat rack (10) for baseball hats (12) and related articles (14) comprising a base member (16) and a stanchion (18). A structure (20) is for retaining the stanchion (18) upon the base member (16). A plurality of pegs (22) are provided. A facility (24) is for mounting inner ends of the pegs (22) at evenly spaced vertical intervals within the stanchion (180 at opposite sides thereof, so that the baseball hats (12) and related articles (14) can be hung on the pegs (22).

17 Claims, 3 Drawing Sheets

BASEBALL BAT RACK FOR BASEBALL HATS AND RELATED ARTICLES

BACKGROUND OF THE INVENTION

1. Field of the Invention

The instant invention relates generally to garment stands and more specifically it relates to a baseball bat rack for baseball hats and related articles.

2. Description of the Prior Art

Numerous garment stands have been provided in prior art. For example, U.S. Pat. No. 1,747,951 to Reichert; U.S. Pat. No. 2,010,093 to Lazarus; U.S. Pat. No. Des. 285,147 to LeCocq, Jr. and U.S. Pat. No. Des. 363,613 to Ehrmann all are illustrative of such prior art. While these units may be suitable for the particular purpose to which they address, they would not be as suitable for the purposes of the present invention as heretofore described.

REICHERT, JOHN

HAT DISPLAY RACK

U.S. Pat. No. 1,747,951

In a rack, a base structure including, crossed foot forming channel bars having the channels on their upper sides. A member secures the bars together at their point of crossing. The member engaged and fitting into the channels of the bars, respectively, at opposite sides thereof to maintain the bars against lateral movement.

LAZARUS, PETER L.

SUPPORTING DEVICE FOR HATS AND GARMENTS

U.S. Pat. No. 2,010,093

As an article of manufacture, an element adapted as a support for hats and articles of wearing apparel. The element consisting of a disc of substantial thickness is adapted for mounting in perimetral engagement with the article to be supported. The element is formed of rubber and has an opening axially therethrough to receive a garment-supporting structure. The rubber forming the element is characterized by a highly cellular internal structure, presenting to the garment thin irregular cell walls of rubber and intervening cell openings. The element further is susceptible of substantial stretch and deformation, and is of a highly compressible nature.

LaCOCQU, JR., MELVIN D.

RACK FOR BASEBALL, BAT, GLOVE AND HAT

U.S. Pat. No. Des. 285,147

The ornamental design for a rack for a baseball, bat, glove and hat, as shown and described.

FIG. 6 is a bottom plan view thereof.

FIG. 7 is a left side elevational view thereof.

Figure 2:
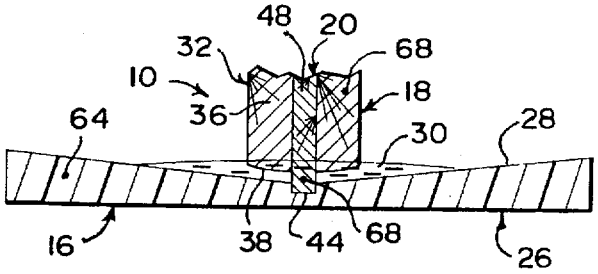
FIG. 2 is a front elevational view thereof.

EHRMANN, RONALD S.

SPORTS CAP RACKS FOR RETAINING FOOTBALL CAPS

U.S. Pat. No. Des. 363,613

The ornamental design for cap racks for retaining football caps, as shown and described. The sole FIGURE is a front, bottom and right side perspective view of a sports cap rack for retaining football caps. The rear and top edge are unornamented and the left side is a mirror image.

SUMMARY OF THE INVENTION

A primary object of the present invention is to provide a baseball bat rack for baseball hats and related articles that will overcome the shortcomings of the prior art devices.

Another object is to provide a baseball bat rack for baseball hats and related articles that will occupy a minimum of floor and room space, while enabling a relatively large number of baseball garments to be supported thereon.

An additional object is to provide that utilizes a simulated baseball bat for its stanchion and a simulated home plate for its base, so as to present a pleasing and attractive appearance when assembled for use.

A further object is to provide a baseball bat rack for baseball hats and related articles that is simple and easy to use.

A still further object is to provide a baseball bat rack for baseball hats and related articles that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Figure 1:
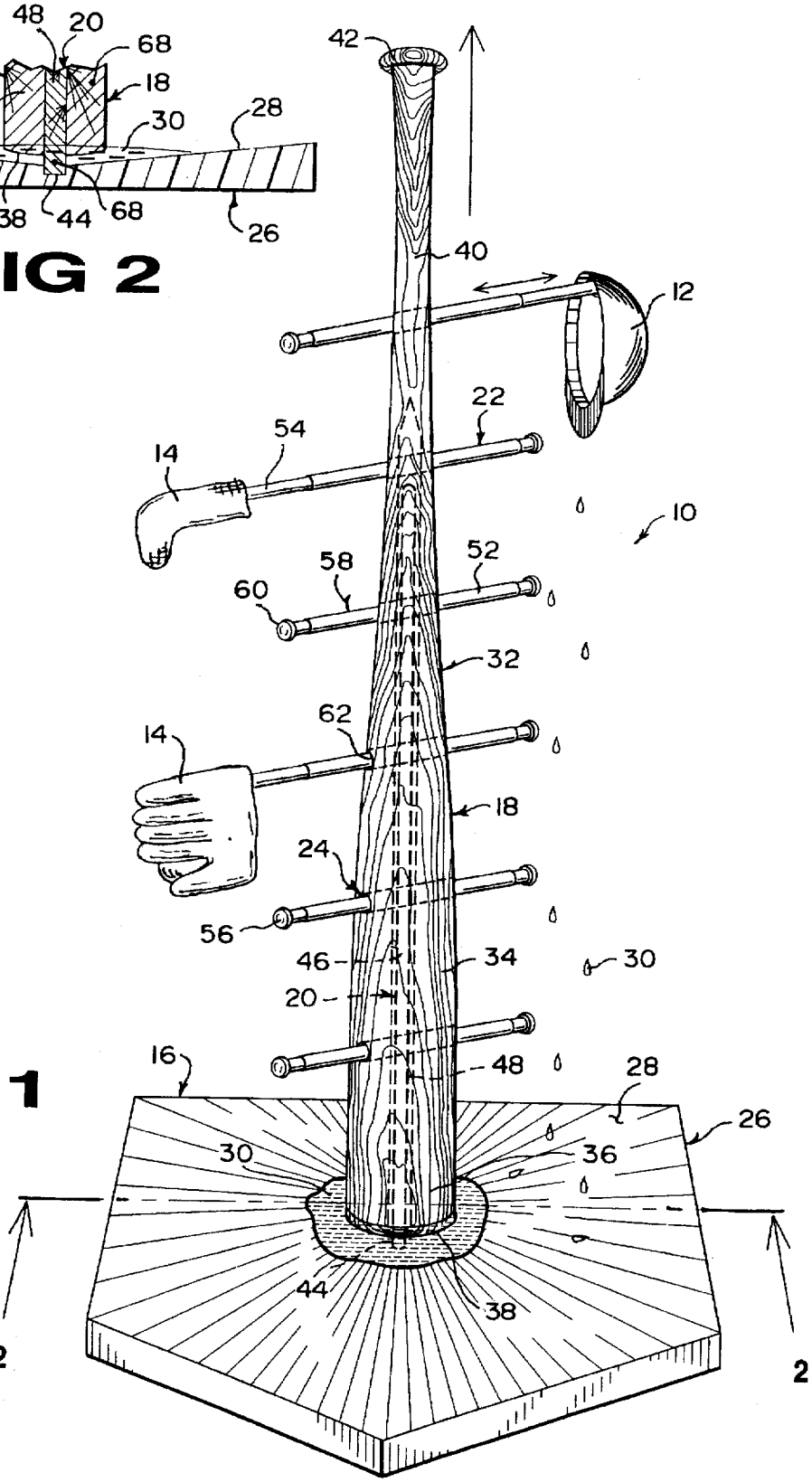
FIG. 1 is a perspective view of a rack for a baseball, bat, glove and hat showing a new design.

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view of the instant invention assembled and in use.

FIG. 2 is a cross sectional view taken along line 2—2 in FIG. 1, with parts broken away.

Figure 3:
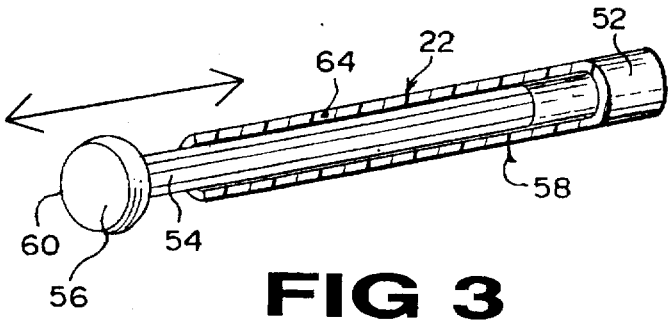
FIG. 3 is a rear elevational view thereof.

FIG. 3 is an enlarged perspective view of one of the adjustable pegs with the outer tubular stationary member broken away and in section.

Figure 4:
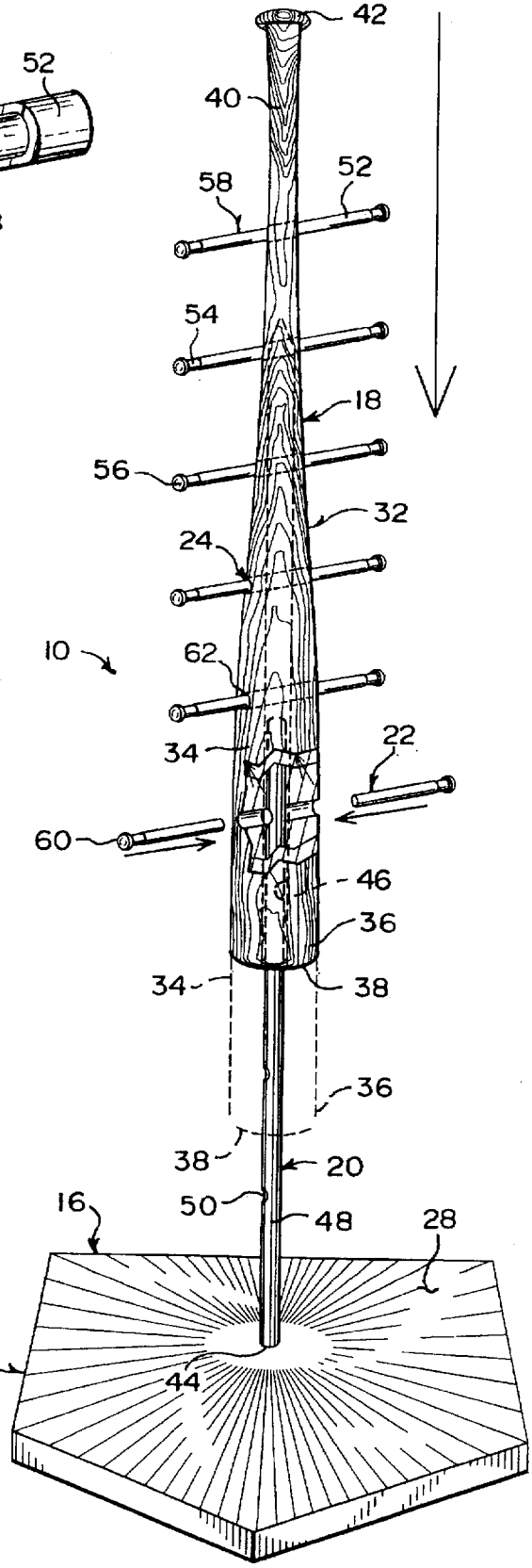
FIG. 4 is a top plan view thereof.

FIG. 4 is a perspective view similar to FIG. 1, partly assembled with the stanchion broken away and in section.

Figure 5:
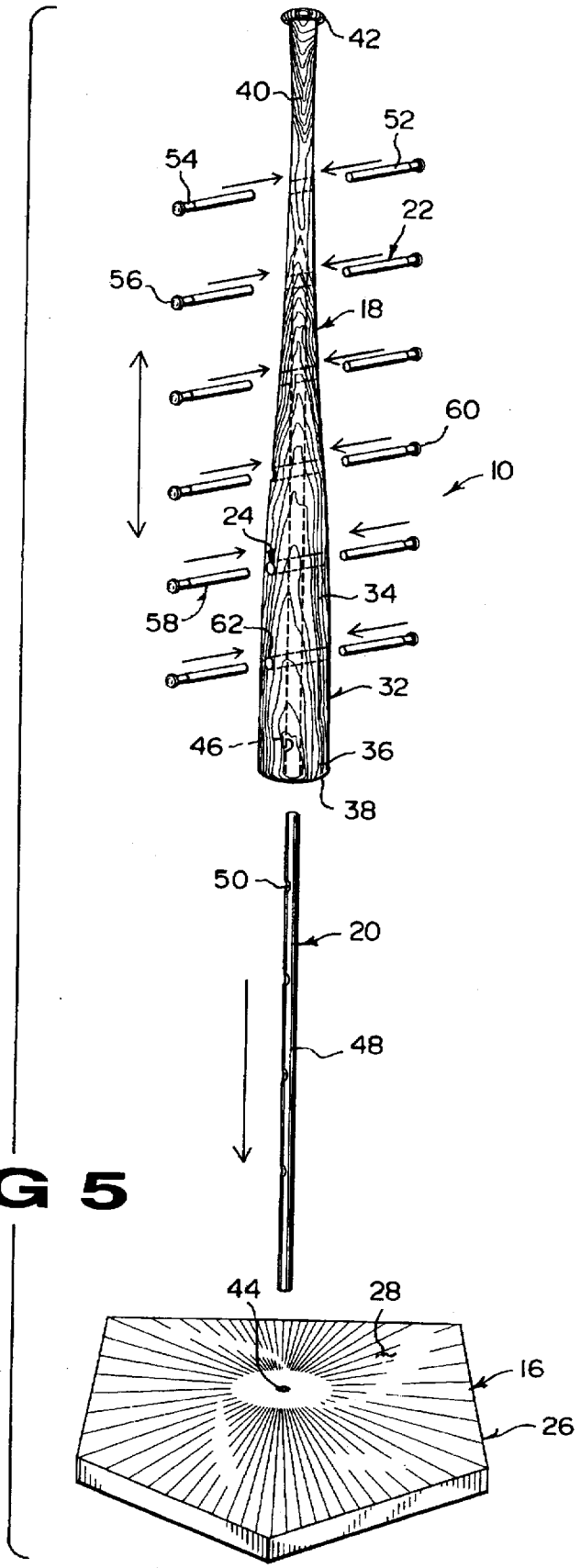
FIG. 5 is a right side elevational view thereof.

FIG. 5 is a perspective view similar to FIG. 1, showing the various components completely exploded apart.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 5 illustrate a baseball bat rack 10 for baseball hats 12 and related articles 14, comprising a base member 16 and a stanchion 18. A structure 20 is for retaining the stanchion 18 upon the base member 16.

A plurality of pegs 22 are provided. A facility 24 is for mounting inner ends of the pegs 22 at evenly spaced vertical intervals within said stanchion 18 at opposite sides thereof, so that the baseball hats 12 and related articles 14, such as socks, baseball gloves, etc., can be hung on said pegs 22.

The base member 16 is a simulated baseball home plate 26. The base member 16 includes a top surface 28 inwardly sloped towards the center, so that any moisture 30 deposited on the top surface 28 will be gathered at the center.

The stanchion 18 is a simulated baseball bat 32. The simulated baseball bat 32 comprises a barrel 34 having a large butt 36 at a bottom end 38, which normally faces downwardly towards the base member 16. A handle 40 is integral with the barrel 34. A knob 42 is on a distal free end of the handle 40, which normally faces upwardly away from the base member 16.

The retaining structure 20 consists of the base member 16 having a socket 44 centrally located in the top surface 28. The stanchion 18 has a longitudinal bore 46 extending inwardly from the bottom end 38. An elongate support rod 48 is provided. One end of the support rod 48 fits into the socket 44 in the base member 16. The support rod 48 fits into the longitudinal bore 46 in the stanchion 18, so as to keep the stanchion 18 in a vertical upright position on the base member 16. The support rod 48 has a plurality of spaced apart indentations 50 on opposite sides thereof, which match up with the inner ends of the pegs 22 when the inner ends are placed in the mounting facility 24.

Each peg 22 is length adjustable and includes an outer hollow cylindrical stationary arm 52, having an end that fits snugly within the mounting facility 24. An inner cylindrical movable arm 54 slides within the stationary arm 52. An enlarged head 56 is on a free end of the movable arm 54. Each said peg 22 is a small simulated baseball bat handle 58 with the enlarged head 56 being a knob 60 thereon.

The mounting facility 24 consists of the stanchion 18 having a plurality of transverse apertures 62 therethrough at the evenly spaced vertical intervals. The inner ends of the pegs 22 can be inserted into opposite sides of the transverse apertures 62. The base member 16 and the pegs 22 are fabricated out of plastic 64. The stanchion 18 and the support rod 48 are fabricated out of wood 66.

OPERATION OF THE INVENTION

To use the baseball bat rack 10, the following steps should be taken:

1. Place the base member 16 which is the simulated baseball home plate 26 upon a horizontal flat surface.
2. Insert the bottom end of the elongate support rod 48 into the socket 44 in the inwardly sloped top surface 28 of the base member 16.
3. Position the longitudinal bore 46 in the stanchion 18, which is the simulated baseball bat 32 over the top end of the elongate support rod 48.
4. Push the stanchion 18 down until the elongate support rod 48 is completely into the longitudinal bore 46 and the large butt 36 at the bottom end 38 is adjacent the inwardly sloped top surface 28 of the base member 16.
5. Fit the inner ends of the pegs 22 into the opposite sides of the transverse apertures 62 in the stanchion 18.

6. Adjust the lengths of each of the pegs 22, by sliding each of the inner cylindrical movable arms 54 within each of the outer hollow cylindrical stationary arms 52.
7. Hang the baseball hats 12 and the related articles 14 on the enlarged heads 56 of the pegs 22, whereby any moisture 30 deposited on the inwardly sloped top surface 28 of the base member 16 will be gathered at the center thereof.

LIST OF REFERENCE NUMBERS

10 baseball bat rack
12 baseball hat
14 related article
16 base member of 10
18 stanchion of 10
20 retaining structure of 10
22 peg of 10
24 mounting facility of 10
26 simulated baseball home plate for 16
28 inwardly sloped top surface of 16
30 moisture
32 simulated baseball bat for 18
34 barrel of 32
36 large butt of 34
38 bottom end of 34
40 handle of 32
42 knob of 32
44 socket in 16
46 longitudinal bore in 18
48 elongate support rod of 20
50 indentation on 48
52 outer hollow cylindrical stationary arm of 22
54 inner cylindrical movable arm of 22
56 enlarged head on 54
58 small simulated baseball bat handle for 22
60 knob for 56
62 transverse aperture in 18 for 24
64 plastic for 16 and 22
66 wood for 18 and 48

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A baseball bat rack for baseball hats and related articles comprising:

a) a plastic base member;

b) a wooden stanchion;

c) means for retaining said stanchion upon said base member, said retaining means including:

i) a socket centrally located in a top surface of said base member;

ii) a longitudinal bore extending inwardly from a bottom end of said stanchion; and iii) an elongate wooden support rod in which one end of said support rod fits into said socket in said base member, while said support rod fits into said longitudinal bore in said stanchion, so as to keep said stanchion in a vertical upright position on said base member;

d) a plurality of pegs; and e) means for mounting inner ends of said pegs at evenly spaced vertical intervals within said stanchion at opposite sides thereof, so that the baseball hats and related articles can be hung on said pegs and further including said support rod having a plurality of spaced apart indentations on opposite sides thereof, which match up with the inner ends of said pegs when the inner ends are placed in said mounting means.

2. A baseball bat rack for baseball hats and related articles as recited in claim 1, wherein said base member is a simulated baseball home plate.

3. A baseball bat rack for baseball hats and related articles as recited in claim 1, wherein said base member includes a top surface inwardly sloped towards the center, so that any moisture deposited on said top surface will be gathered at the center.

4. A baseball bat rack for baseball hats and related articles as recited in claim 1, wherein said stanchion is a simulated baseball bat.

5. A baseball bat rack for baseball hats and related articles as recited in claim 4, wherein said simulated baseball bat includes:

a) a barrel having a large butt at a bottom end which normally faces downwardly towards said base member;

b) a handle integral with said barrel; and c) a knob on a distal free end of said handle which normally faces upwardly away from said base member.

6. A baseball bat rack for baseball hats and related articles as recited in claim 1, wherein said retaining means includes:

a) said base member having a socket centrally located in a top surface;

b) said stanchion having a longitudinal bore extending inwardly from a bottom end; and c) an elongate support rod in which one end of said support rod fits into said socket in said base member, while said support rod fits into said longitudinal bore in said stanchion, so as to keep said stanchion in a vertical upright position on said base member.

7. A baseball bat rack for baseball hats and related articles as recited in claim 1, wherein each said peg is length adjustable and includes:

a) an outer hollow cylindrical stationary arm having an end that fits snugly within said mounting means;

b) an inner cylindrical movable arm which slides within said stationary arm; and c) an enlarged head which is on a free end of said movable arm.

8. A baseball bat rack for baseball hats and related articles as recited in claim 7, wherein each said peg is a small simulated baseball bat handle with said enlarged head being a knob thereon.

9. A baseball bat rack for baseball hats and related articles as recited in claim 1, wherein said mounting means includes said stanchion having a plurality of transverse apertures therethrough at the evenly spaced vertical intervals, so that the inner ends of said pegs can be inserted into opposite sides of said transverse apertures.

10. A baseball bat rack for baseball hats and related articles comprising:

a) a base member being a simulated baseball home plate having a top surface inwardly sloped towards the center, so that any moisture deposited on said top surface will be gathered at the center;

b) a stanchion being a simulated baseball bat;

c) means for retaining said stanchion upon said base member;

d) a plurality of pegs; and e) means for mounting inner ends of said pegs at evenly spaced vertical intervals within said stanchion at opposite sides thereof, so that the baseball hats and related articles can be hung on said pegs.

11. A baseball bat rack for baseball hats and related articles as recited in claim 10, wherein said simulated baseball bat includes:

a) a barrel having a large butt at a bottom end which normally faces downwardly towards said base member;

b) a handle integral with said barrel; and c) a knob on a distal free end of said handle which normally faces upwardly away from said base member.

12. A baseball bat rack for baseball hats and related articles as recited in claim 11, wherein said retaining means includes:

a) said base member having a socket centrally located in a top surface;

b) said stanchion having a longitudinal bore extending inwardly from a bottom end; and c) an elongate support rod in which one end of said support rod fits into said socket in said base member, while said support rod fits into said longitudinal bore in said stanchion, so as to keep said stanchion in a vertical upright position on said base member.

13. A baseball bat rack for baseball hats and related articles as recited in claim 12, further including said support rod having a plurality of spaced apart indentations on opposite sides thereof, which match up with the inner ends of said pegs when the inner ends are placed in said mounting means.

14. A baseball bat rack for baseball hats and related articles as recited in claim 13, wherein each said peg is length adjustable and includes:

a) an outer hollow cylindrical stationary arm having an end that fits snugly within said mounting means;

b) an inner cylindrical movable arm which slides within said stationary arm; and c) an enlarged head which is on a free end of said movable arm.

15. A baseball bat rack for baseball hats and related articles as recited in claim 14, wherein each said peg is a small simulated baseball bat handle with said enlarged head being a knob thereon.

16. A baseball bat rack for baseball hats and related articles as recited in claim 15, wherein said mounting means includes said stanchion having a plurality of transverse apertures therethrough at the evenly spaced vertical intervals, so that the inner ends of said pegs can be inserted into opposite sides of said transverse apertures.

17. A baseball bat rack for baseball hats and related articles as recited in claim 16, wherein said base member and said pegs are fabricated out of plastic, while said stanchion and said support rod are fabricated out of wood.

* * * * *